US008640425B2

(12) United States Patent
Welty

(10) Patent No.: US 8,640,425 B2
(45) Date of Patent: Feb. 4, 2014

(54) METHOD FOR INSTALLING FLASHING ON THE EXTERIOR SIDING OF A BUILDING WITH A CUSTOM TOOL

(76) Inventor: Lee Welty, Fort Bragg, CA (US)

( * ) Notice: Subject to any disclaimer, the term of this patent is extended or adjusted under 35 U.S.C. 154(b) by 0 days.

(21) Appl. No.: 13/438,847

(22) Filed: Apr. 4, 2012

(65) Prior Publication Data

US 2013/0263550 A1 Oct. 10, 2013

(51) Int. Cl.
*E04G 23/00* (2006.01)
*E04G 21/00* (2006.01)
*E04B 1/00* (2006.01)

(52) U.S. Cl.
USPC ..... 52/748.1; 7/105

(58) Field of Classification Search
USPC ..... 52/58, 518, 527, 748.1, DIG. 1; 7/105; 81/489, 491
See application file for complete search history.

(56) References Cited

U.S. PATENT DOCUMENTS 1,082,952 A * 12/1913 Hobbs ..... 7/143
1,598,986 A * 9/1926 Ping ..... 33/647
1,710,113 A * 4/1929 Rothermel ..... 30/142
1,963,632 A * 6/1934 Smith ..... 29/91
4,197,626 A * 4/1980 Golovich ..... 29/270
4,580,302 A * 4/1986 Barth ..... 7/152
5,884,435 A * 3/1999 David et al. ..... 52/62
5,894,624 A * 4/1999 Fulenwider ..... 15/111
6,904,729 B1 * 6/2005 Shroyer ..... 52/510
7,434,318 B2 * 10/2008 Perez et al. ..... 30/169
7,721,488 B1 * 5/2010 Bennett ..... 52/58
7,748,190 B1 * 7/2010 Loper ..... 52/520
7,788,855 B2 * 9/2010 Mileti et al. ..... 52/58
8,245,753 B2 * 8/2012 Haemerle ..... 156/579
D682,498 S * 5/2013 Sonne ..... D32/48
2003/0084545 A1 * 5/2003 Cheng ..... 16/430
2003/0177736 A1 * 9/2003 Gatherum ..... 52/741.1
2009/0223064 A1 * 9/2009 Venderley ..... 30/169

* cited by examiner

*Primary Examiner* — Brian Glessner
*Assistant Examiner* — Paola Agudelo
(74) *Attorney, Agent, or Firm* — Plager Schack, LLP

(57) ABSTRACT

This is directed to systems, processes, machines, and other means that all a user to install flashing without removing exterior siding. The invention can allow a user to quickly and easily allow flashing which enables a structure to be more weather resistant.

5 Claims, 2 Drawing Sheets

METHOD FOR INSTALLING FLASHING ON THE EXTERIOR SIDING OF A BUILDING WITH A CUSTOM TOOL

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION BY REFERENCE OF MATERIAL SUBMITTED ON A COMPACT DISC

Not Applicable

FIELD OF THE INVENTION

This invention relates to installing flashing beneath the siding on the exterior of a building.

BACKGROUND OF THE INVENTION

Flashing is a piece of metal installed beneath shingles on the exterior of a building used to prevent water from entering the building. Current teaching in the field requires the removal of shingles before the installation of flashing or installing the flashing before the shingles are installed in the first instance.

The present invention teaches a manner of installing flashing beneath exterior shingles without first removing the shingles, creating a water resistant barrier in a much faster and efficient manner.

BRIEF SUMMARY OF THE INVENTION

The present invention includes methods, systems, and other means for installing flashing underneath exterior siding. A method for installing flashing comprises the following steps: a user must determine the kind of flashing needed; determine the size of flashing needing; insert the flashing into a flashing installation tool; and mechanically couple the flashing to exterior siding. The flashing installation tool comprises a handle, a blade and a notch.

BRIEF DESCRIPTION OF THE SEVERAL VIEWS OF THE DRAWINGS

Figure 1:
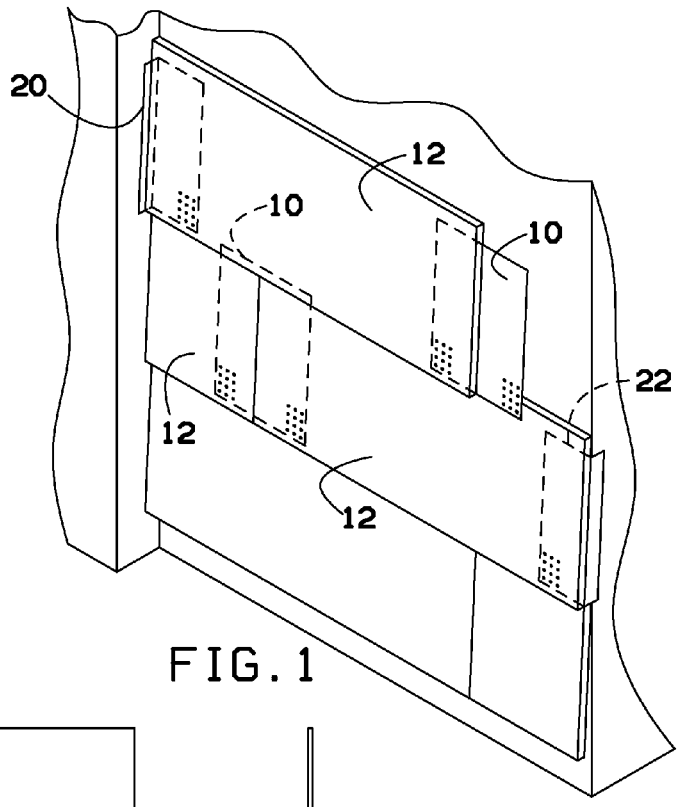

Having thus described the invention in general terms, reference will now be made to the accompanying drawings, which are not necessarily drawn to scale, and wherein:

FIG. 1 is a perspective view of the invention shown in use.

Figure 2:
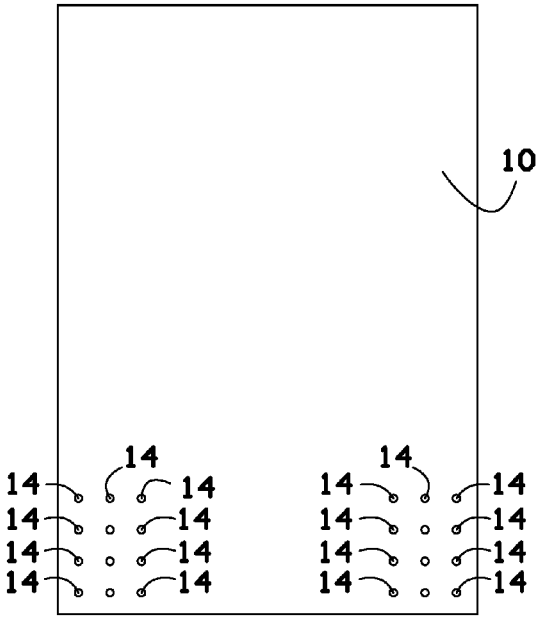

FIG. 2 is a front view of the invention.

Figure 3:
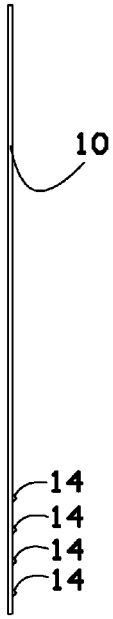

FIG. 3 is a side view of the invention.

Figure 4:
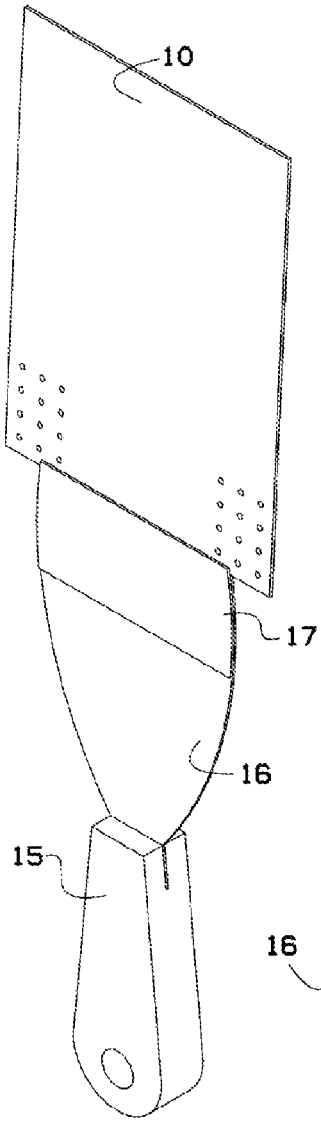

FIG. 4 is a perspective view of the flashing installation tool shown in use.

Figure 5:
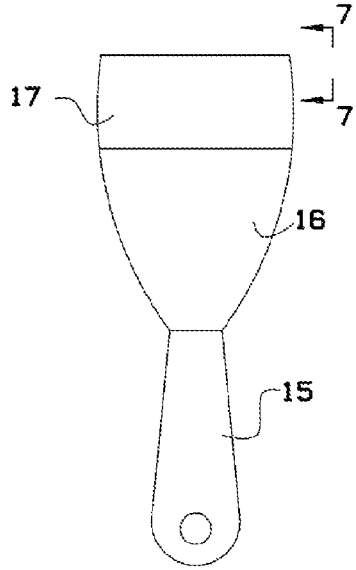

FIG. 5 is a front view of the flashing installation tool.

Figure 6:
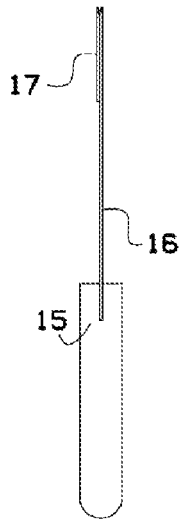

FIG. 6: is a side view of the flashing installation tool.

Figure 7:
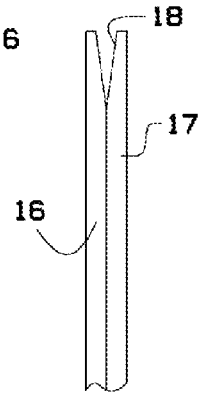

FIG. 7: is a detailed view of the flashing installation tool taken along line 7-7 in FIG. 5.

Figure 8:
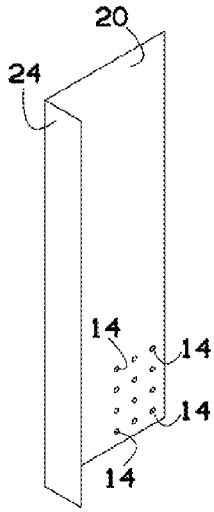

FIG. 8: is a perspective view of an alternate embodiment of the invention shown as the left end flashing.

Figure 9:
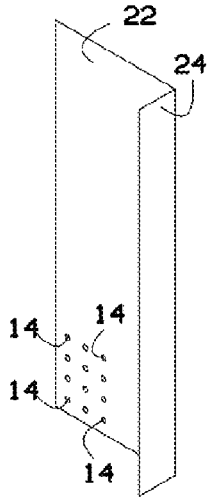

FIG. 9: is a perspective view of an alternate embodiment of the invention shown as the right end flashing.

DETAILED DESCRIPTION OF THE INVENTION

Embodiments of the present invention overcome many of the obstacles associated with installing flashing underneath exterior siding of a building, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. A user desires to install flashing 10 underneath siding 12, which is on an exterior wall. The exterior wall further comprises a left end, where the user desires to install left end flashing 20 and a right end where the user desires to install right end flashing 22.

FIG. 2 shows flashing 10. Flashing 10 can be made from any metal including steel, aluminum, tin and many others. Flashing 10 comprises a series of sharp raised dimples 14. While flashing 10 is shown to be rectangular with 24 raised sharp dimples 14, this is merely exemplary and not drawn to scale, many combinations of sizes, shapes and a number of raised sharp dimples can be effectively used.

FIG. 3 shows a side view of flashing 10. Note that flashing 10 is flat except for raised sharp dimples 14. Previous flashing teaching was to hold the flashing in place with nails. Here, raised sharp dimples 14 hold the siding in place without the need for nails. Raised sharp dimples 14 can be made with known metalworking technology.

FIG. 4 shows flashing 10 being installed by a flashing installation tool. To complete the method the user first determines what kind of flashing is necessary for installation. This could be flashing 10, left end flashing 20 or right end flashing 22. The user then determines the shape of the flashing based on the needs of the particular project. For instance, flashing is usually similar in size to the shingles being used. Next the user puts flashing 10, left end flashing 20 or right end flashing 22 into flashing installation tool 16. After that the user moves flashing installation tool 16 into the position where flashing is desired. The user then pushes flashing 10, left end flashing 20 or right end flashing 22 underneath the shingle with flashing installation tool 16 and the flashing will be held in place by sharp raised dimples 14.

FIG. 5 shows the flashing installation tool in more detail. Flashing installation tool comprises handle 15 mechanically coupled to a blade 16 as shown in FIG. 6. The blade is further mechanically coupled to plate 17 forming a notch 18 between plate 17 and blade 16 as shown in FIG. 7.

FIG. 6 shows a side profile of the flashing installation tool. Handle 15 is mechanically coupled to blade 16, as noted above. This mechanically couple can be accomplished by screws, nails, epoxy, rivets, press fitting or any other known mechanical couple.

FIG. 7 shows notch 18 in more detail. Note that notch 18 exists between a first edge on blade 16 and a second edge on plate 17 forming a depressed center section. The depressed center section should be of adequate size to hold flashing 10

(not shown) firmly without allowing space for flashing 10 to fall from the flashing installation tool.

FIG. 9 shows left end flashing 22 in more detail. Left end flashing 22 comprises flange 24 and further comprises a plurality of raised sharp dimples 14. While flashing 22 is shown to be rectangular with 12 raised sharp dimples 14, this is merely exemplary and not drawn to scale, many combinations of sizes, shapes and a number of raised sharp dimples can be effectively used.

That which is claimed:

1. A method for installing flashing underneath exterior siding, comprising:

determining a kind of flashing needed;

determining a size of flashing needing;

inserting the flashing into a flashing installation tool; wherein the flashing installation tool further comprises a handle mechanically coupled to a blade further comprising a first edge; wherein the blade is further mechanically coupled to a plate comprising a second edge; wherein the first edge and the second edge are immediately adjacent to one another forming a notch wherein the notch accommodates the flashing and mechanically coupling the flashing to the exterior siding.

2. The method for installing flashing underneath exterior siding of claim 1, further comprising, wherein the kind of flashing needed is left end flashing;

wherein the left end flashing further comprises a flange;

wherein the left end flashing further comprises raised sharp dimples.

3. The method for installing flashing underneath exterior siding of claim 1, further comprising, wherein the kind of flashing needed is right end flashing;

wherein the right end flashing further comprises a flange;

wherein the right end flashing further comprises raised sharp dimples.

4. The method for installing flashing underneath exterior siding of claim 1, further comprising, wherein the flashing installation tool further comprises a handle mechanically coupled to a blade;

wherein the blade is mechanically coupled to a notch.

5. A flashing installation tool, comprising:

a handle mechanically coupled to a blade further comprising a first edge; wherein the blade is further mechanically coupled to a plate comprising a second edge; wherein the first edge and the second edge are tapered and immediately adjacent to one another forming a notch wherein the notch is configured to accommodate the flashing.

* * * * *